US009046859B2

(12) United States Patent
Koyanagi et al.

(10) Patent No.: US 9,046,859 B2
(45) Date of Patent: Jun. 2, 2015

(54) SHEET CONVEYANCE APPARATUS AND IMAGE FORMING APPARATUS

(71) Applicant: CANON KABUSHIKI KAISHA, Tokyo (JP)

(72) Inventors: Noriaki Koyanagi, Toride (JP); Takafumi Monte, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/921,091

(22) Filed: Jun. 18, 2013

(65) Prior Publication Data

US 2014/0153991 A1 Jun. 5, 2014

(30) Foreign Application Priority Data

Jun. 19, 2012 (JP) ..... 2012-137920

(51) Int. Cl.
*G03G 15/00* (2006.01)

(52) U.S. Cl.
CPC ..... *G03G 15/6576* (2013.01)

(58) Field of Classification Search
CPC ..... B41J 11/0005; G03G 2215/0005; G03G 2215/00662; B65H 23/34; B65H 2301/51256
USPC ..... 271/209, 188; 162/271, 197; 399/406
See application file for complete search history.

(56) References Cited

U.S. PATENT DOCUMENTS

| | | | | |
|---|---|---|---|---|
| 5,017,970 | A * | 5/1991 | Sakata | 399/67 |
| 5,565,971 | A * | 10/1996 | Kuo et al. | 399/406 |
| 2010/0135708 | A1* | 6/2010 | Goto | 399/406 |
| 2011/0142518 | A1* | 6/2011 | Nishida | 399/406 |

FOREIGN PATENT DOCUMENTS

JP 2002-326753 A 11/2002

* cited by examiner

*Primary Examiner* — Matthew G Marini
(74) *Attorney, Agent, or Firm* — Canon USA Inc IP Division

(57) ABSTRACT

A curl correction apparatus includes a supporting member. The supporting member supports a shaft of an elastic roller and a shaft of a metal roller at a first position, and supports only one of the shaft of the elastic roller and the shaft of the metal roller at a second position. When the supporting member is located at the second position, the nip between the elastic roller and the metal roller can be opened by moving the other of the elastic roller and the metal roller.

20 Claims, 15 Drawing Sheets

SHEET CONVEYANCE APPARATUS AND IMAGE FORMING APPARATUS

BACKGROUND OF THE INVENTION

1. Field of the Invention

The present disclosure relates to a curl correction apparatus correcting a sheet curl and to an image forming apparatus including the curl correction apparatus.

2. Description of the Related Art

A conventional image forming apparatus such as a copier or a printer includes a curl correction apparatus for removing a sheet curl caused, for example, in a fixing process in which heat and pressure is applied to a sheet.

Japanese Patent Application Laid-Open No. 2002-326753 discusses a curl correction apparatus that corrects a sheet curl by causing a sheet to pass through a nip portion between a drive roller and a pressure roller (a curl correction roller pair). FIGS. 14 and 15 are a perspective view and a side view of the curl correction apparatus discussed in Japanese Patent Application Laid-Open No. 2002-326753, respectively.

The curl correction apparatus in FIGS. 14 and 15 includes pressing force regulating plates 73 for pinching rotation shafts 71*a* and 72*a* of a drive roller 71 and a pressure roller 72. By rotating the pressing force regulating plates 73, a pinching portion for pinching the rotation shafts 71*a* and 72*a* can be changed among pinching portions 77*a*, 77*b*, and 77*c*.

In this way, in the curl correction apparatus discussed in Japanese Patent Application Laid-Open No. 2002-326753, since the pressing force regulating plates 73 pinch both of the rotation shafts of the two rollers, the distance between the rotation shafts of the two rollers can be stably maintained, and stable curl removal performance can be obtained. In addition, since the pinching portions 77*a*, 77*b*, and 77*c* has a certain width in a moving direction of the pressing force regulating plates 73, the drive roller and the pressure roller can be adjusted to have a desired pressing force.

However, in the curl correction apparatus discussed in Japanese Patent Application Laid-Open No. 2002-326753, since the pressing force regulating plates 73 pinch both of the rotation shaft 71*a* of the drive roller 71 and the rotation shaft 72*a* of the pressure roller 72, the nip between the drive roller 71 and the pressure roller 72 cannot be opened. Thus, if a jam occurs inside the apparatus, it is difficult to remove a jammed sheet. In particular, in a jam clearance operation when an accordion shape jam occurs, the sheet may be torn and part of the torn sheet may be left inside the apparatus, preventing conveyance of subsequent sheets.

There is a possible configuration for improving the jam recovery. That is, by providing an openable conveyance guide with one of the drive roller and the pressure roller and by almost integrally opening and closing the conveyance guide and the roller, the nip between the drive roller and the pressure roller can be opened.

However, with this configuration, it is necessary that each of the drive roller and the pressure roller be held in a different holding portion such as a conveyance guide or a casing. Thus, to maintain a certain distance between the shafts of the drive roller and the pressure roller, higher strength is required for the conveyance guides. In addition, high component accuracy and positional accuracy of latch means are required. Therefore, to increase strength of parts, it is necessary to increase the number of parts and to improve accuracy in processing parts, resulting in an increase of the cost for manufacturing the apparatus.

SUMMARY OF THE INVENTION

The present disclosure is directed to providing a curl correction apparatus capable of stably maintaining the distance between the shafts of a curl correction roller pair and allowing a user to easily remove a sheet when a jam clearance operation is executed, without a significant cost increase.

A curl correction apparatus includes an elastic roller and a counter roller configured to face the elastic roller. A curl of a sheet is corrected by the sheet passing through a nip portion between the elastic roller and the counter roller. The curl correction apparatus further includes a supporting unit configured to support shafts of the elastic roller and shafts of the counter roller so that the counter roller into the elastic roller to form the nip portion at a first position, and configured to support one of the shafts of the elastic roller and the shafts of the counter roller at a second position. The curl correction apparatus further includes a supporting unit moving unit configured to move the supporting unit between the first position and the second positions. In a case where the supporting unit is located at the second position, the nip portion between the elastic roller and the counter roller is opened by moving one of the elastic roller and the counter roller.

Further features and aspects of the present invention will become apparent from the following detailed description of exemplary embodiments with reference to the attached drawings.

DESCRIPTION OF THE EMBODIMENTS

Various exemplary embodiments, features, and aspects of the invention will be described in detail below with reference to the drawings.

Figure 1:
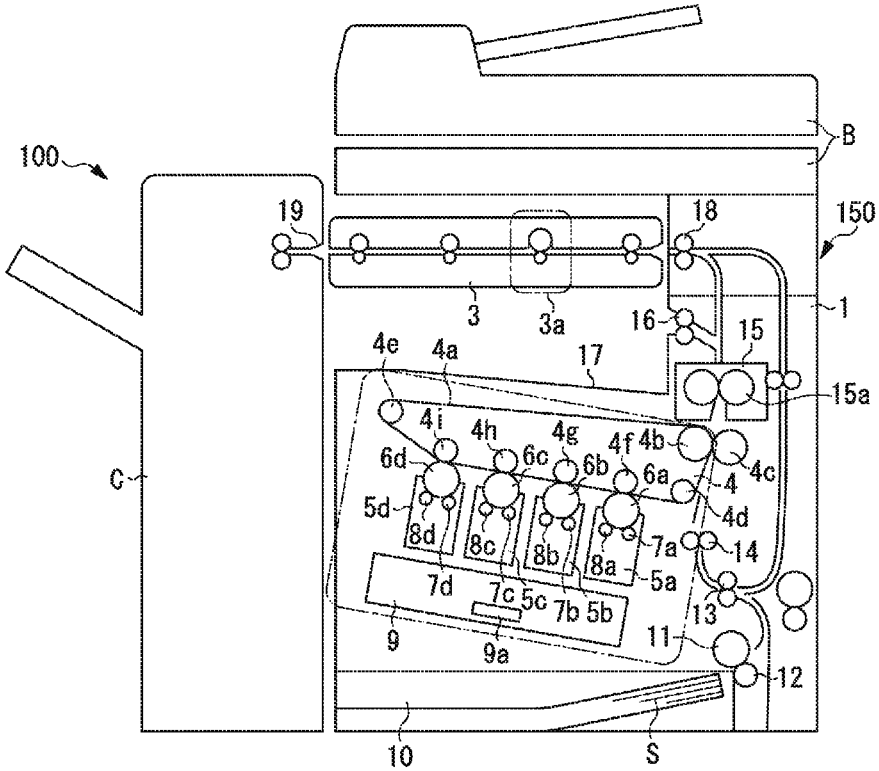
FIG. 1 illustrates an overall configuration of an image forming apparatus to which a curl correction apparatus is applied.

FIG. 1 is a schematic sectional view of an image forming apparatus 100 to which a curl correction apparatus according to the present disclosure is applied. As illustrated in FIG. 1, the image forming apparatus 100 includes a printer unit 150 serving as an image forming unit forming an image on a sheet, an image reading apparatus B, and a post-processing apparatus C.

The printer unit 150 includes an apparatus main body 1 and a relay conveyance apparatus 3 according to the first exemplary embodiment that is installed approximately horizontally on the top of the apparatus body 1. The apparatus main body 1 includes detachable process cartridges 5*a* to 5*d* storing toner of four different colors of cyan, magenta, yellow, and black. These process cartridges 5*a* to 5*d* include electrophotographic photosensitive drums 6*a* to 6*d* serving as image carriers, respectively.

A scanner unit emits laser light to form a toner image on each of the photosensitive drums 6*a* to 6*d*, and primary transfer rollers 4*f* to 4*i* arranged on the back side of an intermediate transfer belt 4*a* transfer the toner image on the front side of the intermediate transfer belt 4*a*.

A fixing unit 15 for fixing the toner image transferred onto a sheet S, a first discharging unit 16 for discharging the sheet S onto a discharge tray 17, and the relay conveyance apparatus 3 for conveying the sheet S to the post-processing apparatus C are arranged above an intermediate transfer unit 4.

The process cartridges 5*a* to 5*d* are sequentially driven in accordance with image printing timing, and the photosensitive drums 6*a* to 6*d* are rotated clockwise in accordance with driving of the process cartridges 5*a* to 5*d*. When a polygon 9*a* of a laser scanner 9 starts to rotate, charging devices 7*a* to 7*d* apply uniform electric charges to the circumferential surfaces of the respective photosensitive drums 6*a* to 6*d*. Based on an image signal, the laser scanner 9 exposes the circumferential surfaces of the photosensitive drums 6*a* to 6*d* and forms electrostatic latent images on the photosensitive drums 6*a* to 6*d*. Developing rollers 8*a* to 8*d* in a developing device shift toner to low voltage parts of the electrostatic latent images and form toner images on the circumferential surfaces of the photosensitive drums 6*a* to 6*d*.

The transfer belt 4*a* of the intermediate transfer unit 4 is suspended across a drive roller 4*b*, an idler roller 4*d*, and a tension roller 4*e* and is driven by the drive roller 4*b* counterclockwise. The primary transfer rollers 4*f* to 4*i* facing each of the photosensitive drums 6*a* to 6*d*, respectively, are rotated counterclockwise by friction with the intermediate transfer belt 4*a*. When a voltage is applied to each of the primary transfer rollers 4*f* to 4*i*, a toner image on each of the photosensitive drums 6*a* to 6*d* is transferred onto the intermediate transfer belt 4*a* by an electric field formed between each of the photosensitive drums 6*a* to 6*d* and each of the primary transfer rollers 4*f* to 4*i*. When the toner image of the four colors transferred onto the intermediate transfer belt 4*a* reaches a secondary transfer roller 4*c*, the toner image is attracted toward the secondary transfer roller 4*c* by an electric field formed by a voltage applied to the secondary transfer roller 4*c* and is transferred onto the conveyed sheet S. The sheet S onto which the toner image of the four colors has been transferred is separated by curvature of the drive roller 4*b* and is conveyed to the fixing device 15. While the sheet S is conveyed by a fixing roller pair 15*a* in the fixing device 15, heat and pressure is applied to the sheet S. In this way, a plurality of colors of toner image is fixed on the front side of the sheet S.

The sheet S stored in a sheet cassette 10 arranged below the laser scanner 9 is conveyed, as a sheet feed roller 11 rotates counterclockwise. Next, a sheet separation means 12 that abuts on the sheet feed roller 11 separates sheets one by one, and a separated sheet is conveyed to a conveyance roller pair 13.

The leading edge of the sheet conveyed by the conveyance roller pair 13 abuts on a registration roller pair 14 whose rotation has been stopped. In this way, a loop is formed in the sheet and the skew of the sheet is corrected. The toner image on the intermediate transfer belt 4*a* is controlled so that the toner image is aligned with the sheet conveyed by the registration roller pair 14. A secondary transfer roller 4*c* transfers the toner image onto the sheet and a fixing roller 15*a* applies heat and pressure to fix the image on the sheet. Next, the discharge roller pair 16 discharges the sheet to the outside of the apparatus main body 1 to stack the sheet on a discharge tray 17.

If post-processing such as stapling or saddle folding is executed on a sheet on which an image is formed, the sheet is conveyed to the post-processing apparatus C arranged parallel to the apparatus main body 1. If a sheet is conveyed to the post-processing apparatus C, the discharge roller pair 18 conveys the sheet to the relay conveyance apparatus 3 and then to the post-processing apparatus C through a carry-in port 19.

Figure 2:
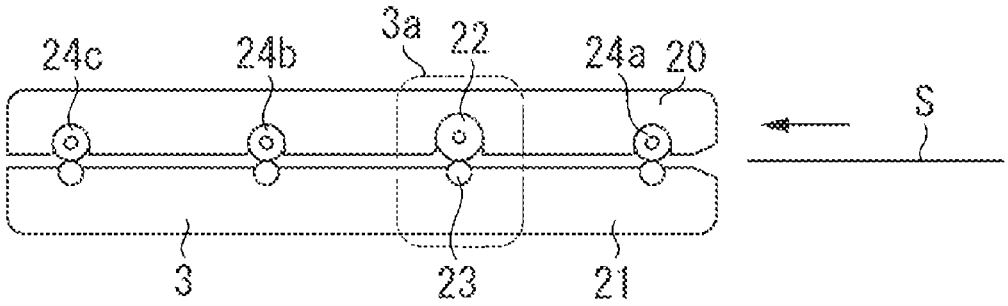
FIG. 2 is a sectional view of a configuration of a relay conveyance apparatus.
Figure 3:
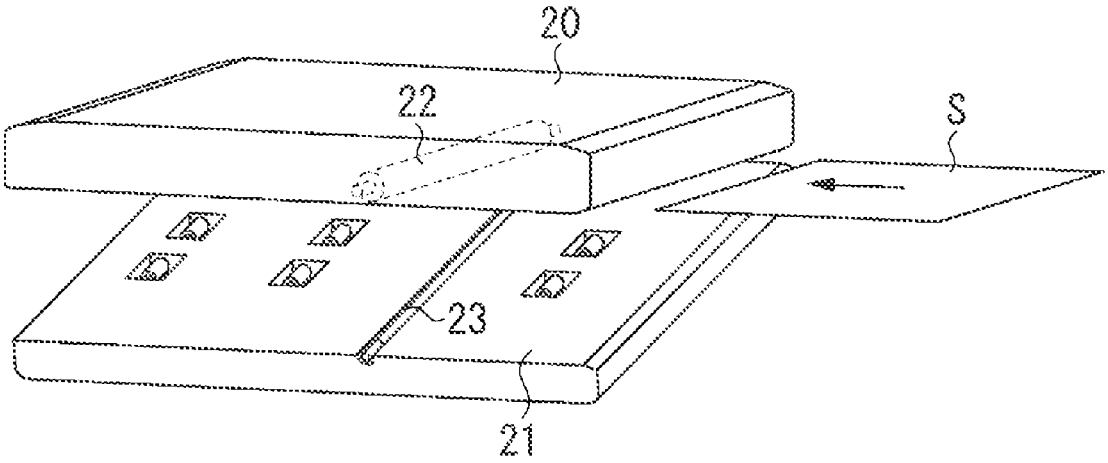
FIG. 3 illustrates an opening/closing operation of conveyance guides of the relay conveyance apparatus.

FIG. 2 is a schematic sectional view of the relay conveyance apparatus 3, and FIG. 3 is a perspective view of the relay conveyance apparatus 3 with a lower conveyance guide 21 being opened.

The relay conveyance apparatus 3 includes an upper conveyance guide 20 and the lower conveyance guide 21 for guiding a conveyed sheet, conveyance rollers 24*a* to 24*c* for conveying a sheet to the post-processing apparatus C, a curl correction apparatus 3*a* for correcting a sheet curl. As illustrated in FIG. 3, the lower conveyance guide 21 can be opened/closed with respect to the upper conveyance guide 20 fixed to the apparatus main body 1.

Figure 4:
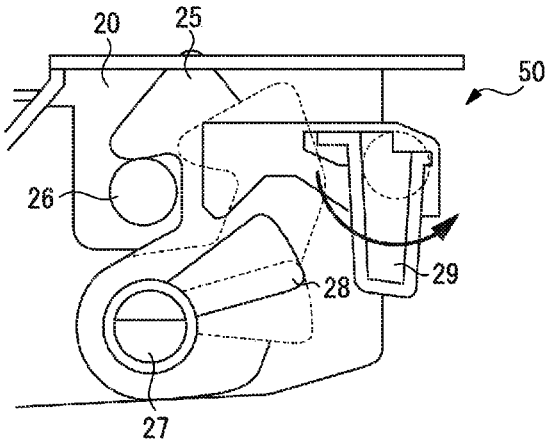
FIG. 4 illustrates a latching means for latching the conveyance guides of the relay conveyance apparatus.

FIG. 4 is a schematic sectional view illustrating a configuration of a latching means 50 of the relay conveyance apparatus 3. The latching means 50 latches the upper and lower conveyance guides 20 and 21 while maintaining a certain distance therebetween.

A latching projection 25 of the latching means 50 is rotatable around rotation shaft 27 and is attached to the lower conveyance guide 21. A lever 28 is attached to the rotation shaft 27 and is connected by a link to a rotatable handle 29 attached to the lower conveyance guide 21. The upper conveyance guide 20 is provided with a shaft portion 26 that can be engaged by the latching projection 25.

A user operates the handle 29 to open and close the lower conveyance guide 21, so that the latching means 50 latches and releases the upper and lower conveyance guides 20 and 21. Namely, when the handle 29 is rotated, the latching projection 25 is released from engagement with the shaft portion 26, and the lower conveyance guide 21 is moved downward with respect to the upper conveyance guide 20 fixed to the apparatus body 1 as illustrated in FIG. 3. Thus, the conveyance path in the relay conveyance apparatus 3 is opened.

A first exemplary embodiment will be described.

Next, a curl correction apparatus 3*a* according to the first exemplary embodiment of the present disclosure will be described.

Figure 5:
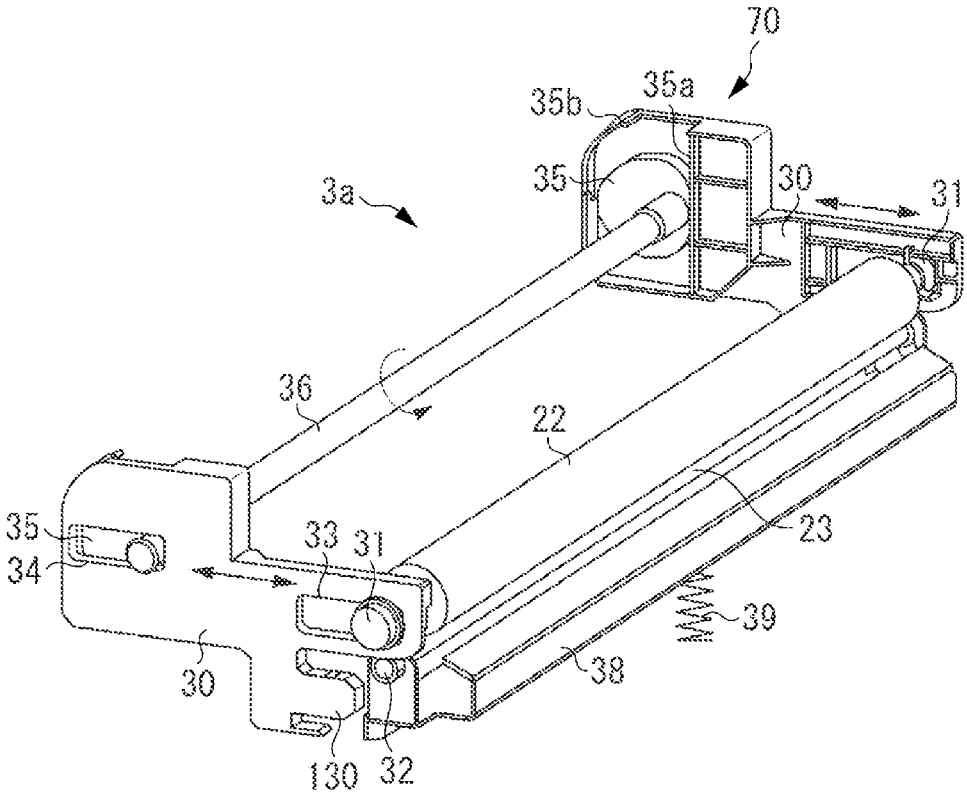
FIG. 5 is a perspective view illustrating a curl correction apparatus according to a first exemplary embodiment.

As illustrated in a perspective view in FIG. 5, the curl correction apparatus 3*a* includes an elastic roller 22 rotationally driven by a drive motor (not illustrated) and a metal roller 23 serving as a counter roller that faces the elastic roller 22 and has higher hardness than the elastic roller 22.

The elastic roller 22 is formed by a metal rotation shaft and a sponge roller covering the surface of the rotation shaft. The elastic roller 22 is pressed by the metal roller 23, so that the sponge portion of the elastic roller 22 is pressed in accordance with the curvature of the metal roller 23. Namely, a nip portion is formed in a state where the metal roller 23 penetrates into the elastic roller 22.

By conveying a sheet on which an image is fixed to the nip portion between the elastic roller 22 and the metal roller 23 and curving the sheet in accordance with the curvature of the metal roller 23 by the pressing force of the metal roller 23 against the elastic roller 22, the curl of the sheet is corrected.

The shaft of the elastic roller 22 is rotatably supported by the upper conveyance guide 20 and held in a state where the position is fixed with respect to the upper conveyance guide 20. The metal roller 23 is provided in the lower conveyance guide 21. As illustrated in FIG. 5, both ends of the metal roller 23 are supported by a housing 38, and the metal roller 23 is urged by a spring 39 in a direction where the metal roller 23 is pressed against the elastic roller 22.

Figure 6:
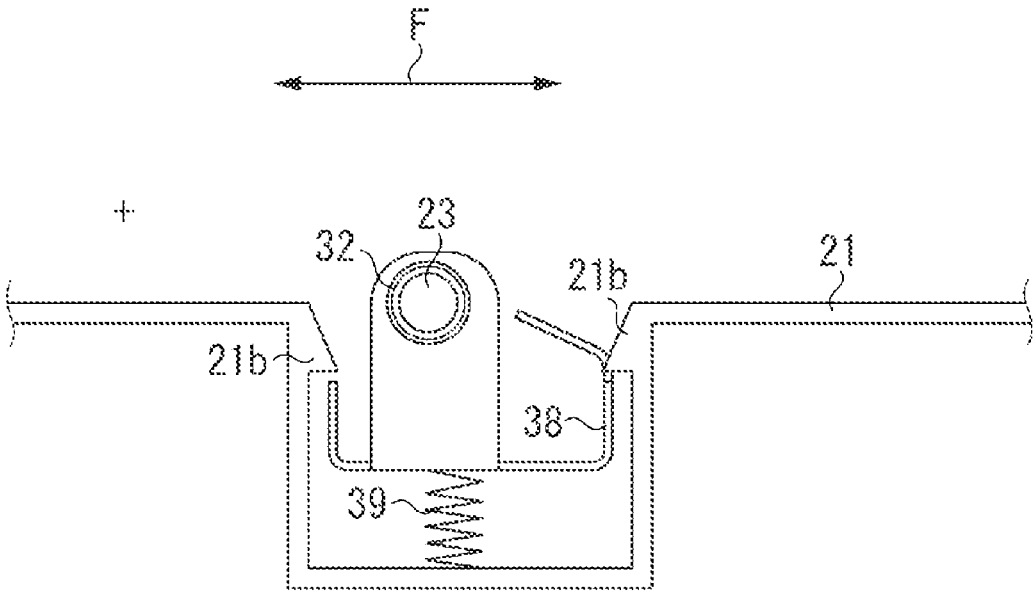
FIG. 6 is a side view illustrating an installation relationship between the curl correction apparatus and a lower conveyance guide according to the first exemplary embodiment.

FIG. 6 is a cross section illustrating a configuration for attaching the metal roller 23 to the plastic lower conveyance guide 21.

The housing 38 supporting the metal roller 23 can move with respect to the lower conveyance guide 21 in a direction in which the metal roller 23 comes into contact with or is separated from the elastic roller 22. The upward movement of the housing 38 in FIG. 6 is regulated by a protrusion 21*b* provided in the lower conveyance guide 21. In addition, the housing 38 is arranged with a gap with the lower conveyance guide 21 in the direction of an arrow F. Thus, the housing 38 is arranged in a state where the housing 38 is not fixed to the lower conveyance guide 21 so that the center position of the rotation shaft of the metal roller 23 can move in a horizontal direction in parallel to the conveyance direction and in a vertical direction.

Figure 7A:
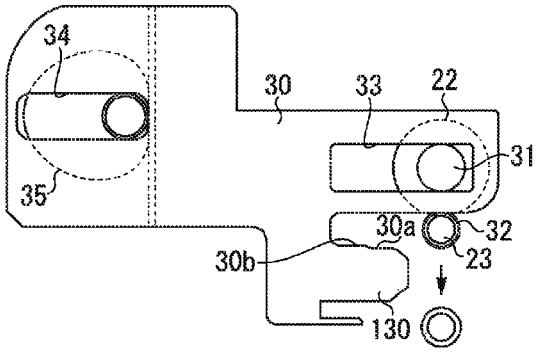
FIGS. 7A and 7B illustrate an operation of supporting members of the curl correction apparatus according to the first exemplary embodiment.
Figure 7B:
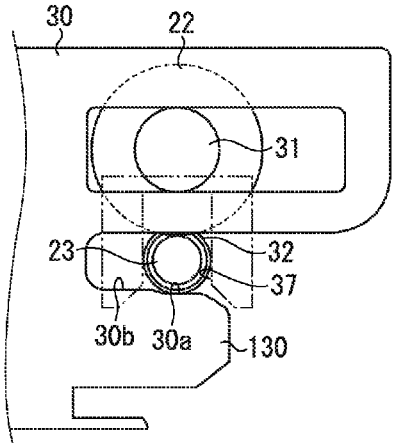

As illustrated in FIGS. 7A and 7B, the upper conveyance guide 20 includes slit grooves 37 for regulating the metal roller 23. In addition, when the lower conveyance guide 21 is closed, bearings 32 of the metal roller 23 are guided to the slit grooves 37 provided in the upper conveyance guide 20, as illustrated in FIG. 7B. In addition, the horizontal movement of the metal roller 23 is regulated by the slit grooves 37. Namely, the horizontal position of the metal roller 23 is determined by the slit grooves 37. Thus, an axis distance between the metal roller 23 and the elastic roller 22 fixed to the upper conveyance guide 20 is maintained (alignment is maintained).

In addition, the curl correction apparatus 3*a* includes supporting members 30 that support both shafts of the elastic roller 22 and the metal roller 23 at a first position and that support only the elastic roller 22 at a second position. In addition, the curl correction apparatus 3*a* includes a supporting member moving mechanism 70 for sliding the supporting members 30 to move between the first position and the second position. FIGS. 7A and 7B are side views illustrating the supporting members 30 at the second and first positions, respectively. As illustrated in FIGS. 7A and 7B, the moving direction of the supporting members 30 is perpendicular to the direction in which the elastic roller 22 and the metal roller 23 are pressed.

As illustrated in FIG. 5, the pair of supporting members 30 is plate-shaped metal members that extend horizontally. Opening grooves 33 and 34 whose shape is elongated hole extending horizontally are formed in both ends of each of the supporting members 30 in the longitudinal direction. The supporting members 30 include supporting protrusions 130, and abutting surfaces 30*a*/30*b* on which the bearings 32 arranged at the ends of the metal roller 23 abut are formed on the supporting protrusions 130. The supporting protrusions 130 extend horizontally below the opening grooves 33. The abutting surfaces 30*a* and 30*b* on the supporting protrusions 130 have heights different from each other.

The bearings 31 and 32 are arranged at both ends of the rotation shafts of the elastic roller 22 and the metal roller 23. The bearings 31 arranged at the ends of the elastic roller 22 fit into the opening grooves 33 in the supporting members 30. In this way, the elastic roller 22 is supported by the supporting members 30. The bearings 32 arranged at the ends of the metal roller 23 come into contact with the abutting surfaces 30*a*/30*b* arranged on the supporting members 30, so that the metal roller 23 is supported by the supporting members 30.

The dimensions of the opening grooves 33 and the abutting surfaces 30*a* and 30*b* on the supporting protrusions 130 are set so that the metal roller 23 engages with the elastic roller 22 when the bearings 32 of the metal roller 23 come into contact with each of the abutting surfaces 30*a*/30*b*.

The distance between the opening grooves 33 and the abutting surface 30*b* of the supporting member 30 is shorter than the distance between the opening grooves 33 and the abutting surface 30*a* of the supporting member 30. The elastic roller 22 is configured so that the metal roller 23 is capable of penetrating into the elastic roller 22. A penetration amount that the metal roller 23 penetrates into the elastic roller 22 with the bearing 32 of the metal roller 23 being in contact with the abutting surface 30*b* is greater than a penetration amount that the metal roller 23 penetrates into the elastic roller 22 with the bearing 32 of the metal roller 23 being in contact with the abutting surface 30*a*.

As illustrated in FIGS. 7A and 7B, the elastic roller 22 is supported by the opening grooves 33 even when the supporting members 30 are located at the first or second position. When the supporting members 30 are located at the first position, the metal roller 23 abuts on the abutting surfaces 30*a* of the supporting members 30 and is supported inside the slit grooves 37. However, when the supporting members 30 are located at the second position, the metal roller 23 is not supported by the supporting members 30. Thus, when the supporting members 30 are located at the second position, the metal roller 23 is released together with the lower conveyance guide 21.

In addition, the supporting members 30 can move to a third position, which is located in the right direction from the first position in FIG. 7B. When the supporting member 30 is located at the third position, the metal roller 23 abuts on the abutting surfaces 30*b* of the supporting members 30 and is supported inside the slit grooves 37. The distance between the shafts of the elastic roller 22 and the metal roller 23 when the supporting members 30 are located at the third position are shorter than that when the supporting members 30 are located at the first position. If the distance between the shafts of the elastic roller 22 and the metal roller 23 is decreased, the nip pressure between the elastic roller 22 and the metal roller 23 is increased.

Figure 8:
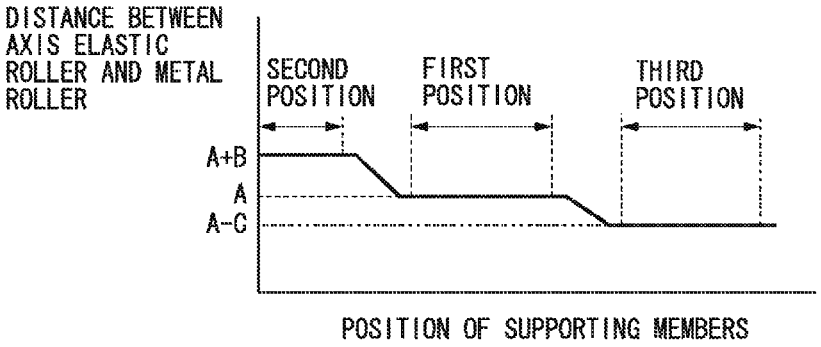
FIG. 8 is a graph illustrating the distance between the shafts of an elastic roller and a metal roller.

FIG. 8 is a graph in which the horizontal axis represents the position of the supporting members 30 and the vertical axis represents the axis distance between the elastic roller 22 and the metal roller 23.

Distance A represents the axis distance between the elastic roller 22 and the metal roller 23 when the supporting members 30 are located at the first position, distance A−C represents the axis distance when the supporting members 30 are located at the third position, and distance A+B represents the axis distance when the supporting members 30 are located at the second position. Namely, the axis distance between the curl correction roller pair is longest at the second position and shortest at the third position.

As described above, while the supporting members 30 allows the nip between the curl correction roller pair to open when located at the second position, the supporting members 30 support the curl correction roller pair to correct a sheet curl when located at the first and third positions.

Next, the supporting member moving mechanism 70 for moving (horizontally in FIG. 5) the supporting members 30 to any one of the first to third positions will be described. As illustrated in FIG. 5, ends of a rotation shaft 36 provided with the cams 35 that is rotated by receiving driving force from a pulse motor 41 are inserted into the opening grooves 34 in the supporting members 30. The outer periphery of the cams 35 is in contact with a first rib 35*a* and a second rib 35*b* formed on the supporting members 30.

While the rotation shaft 36 of the cams 35 is rotatably supported with respect to the upper conveyance guide 20, the rotation shaft 36 is fixed so that the rotation shaft 36 does not move horizontally and vertically.

The cams 35 are moved by driving force from the motor 41, so that the supporting members 30 are moved in the longitudinal direction of the opening grooves 33 and 34, that is, horizontally in FIG. 5. According to the first exemplary embodiment, the supporting member moving mechanism 70 can move the supporting members 30 among the first to third positions by rotating the cams 35.

Figure 10:
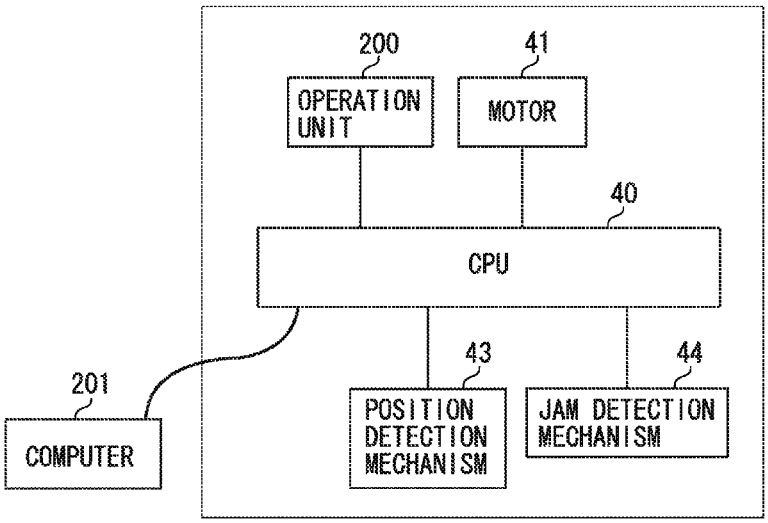
FIG. 10 is a block diagram of an image forming apparatus according to the first exemplary embodiment.

FIG. 10 is a block diagram of the image forming apparatus 100 according to the present disclosure. A central processing unit (CPU) 40 serving as a control unit of the image forming apparatus 100 is connected to a computer 201 connected to the image forming apparatus 100 directly or via a network. In addition, the CPU 40 is connected to the motor 41 that rotates the rotation shaft 36 via a drive train (not illustrated) and to a position detection mechanism 43 that detects the position of the rotation shaft 36. In addition, the CPU 40 is connected to a jam detection mechanism 44 that is arranged in the sheet conveyance path and that detects that a conveyed sheet is jammed.

The position detection mechanism 43 includes a sensor lever and a photo-interrupter arranged for the rotation shaft 36. The cams 35 fixed to the rotation shaft 36 rotate in synchronization with the rotation shaft 36. In addition, the rotation amount of the cams 35 and the rotation shaft 36 is controlled by counting the pulses of the motor 41.

Figure 9:
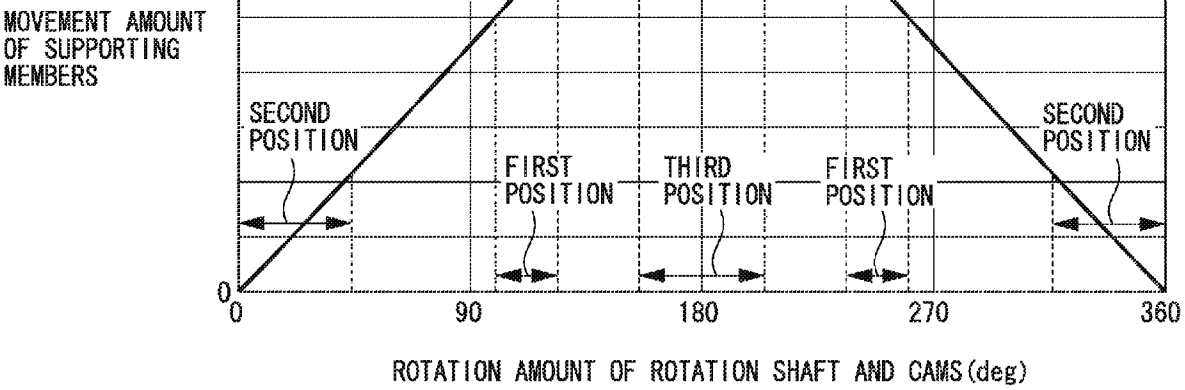
FIG. 9 illustrates a relationship between the rotation angle of the cams of a supporting member moving mechanism and the supporting members.

FIG. 9 illustrates the rotation amount of the rotation shaft 36 and the cams 35 and movement amount of the supporting members 30.

After detecting the second position at which the rotation angle of the cams 35 is 0 degrees, the CPU 40 drives the motor 41 to rotate the cams 35 by a certain amount and moves the supporting members 30 to the first position or the third position. In a case where strong curl correction is executed, the CPU 40 moves the supporting members 30 to the third position. In a case where normal curl correction is executed, the CPU 40 moves the supporting members 30 to the first position. In this way, a sheet curl caused by the fixing device 15 can be corrected.

In addition, when the jam detection mechanism 44 arranged in the sheet conveyance path detects a jam during printing operation, the CPU 40 drives the motor 41 to rotate the rotation shaft 36 by a certain amount and moves the supporting members 30 to the second position. In this case, the jam indicates a sheet jam at the curl correction roller pair. However, when a sheet is jammed in another conveyance path and a sheet is retained at the curl correction roller pair, the CPU 40 also moves the supporting members 30 to the second position.

In this way, by opening the lower conveyance guide 21, a user can open the nip between the curl correction roller pair and remove the jammed sheet easily.

Figure 11:
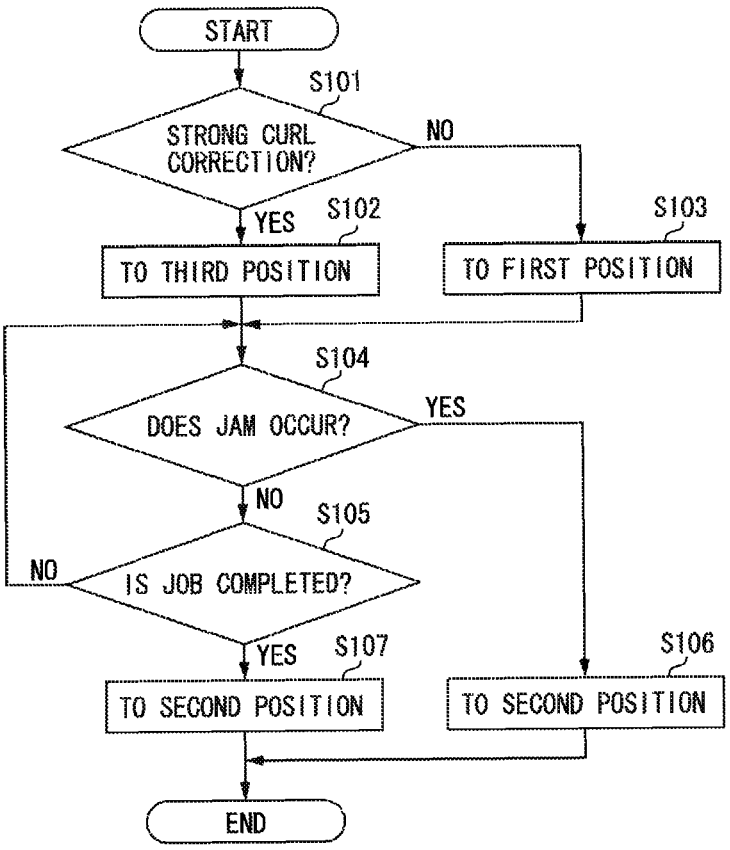
FIG. 11 is a flow chart of a curl correction operation executed by the curl correction apparatus according to the first exemplary embodiment.

Next, a sheet curl correction operation by the curl correction apparatus 3*a* will be described with reference to a flow chart in FIG. 11.

First, a user gives a print instruction via an operation unit 200 of the image forming apparatus 100 or via the computer 201 connected to the image forming apparatus 100 directly or via a network. The user can specify the print copy number, information about sheets to be used (size, grammage, etc.), and a mode for executing strong sheet curl correction.

In step S101, when a print job is started, the CPU 40 determines whether to execute strong sheet curl correction.

If strong sheet curl correction is executed (YES in step S101), the operation proceeds to step S102. In step S102, the CPU 40 controls the motor 41 to move the supporting members 30 to the third position. If strong sheet curl correction is not executed (NO in step S101), the operation proceeds to step S103. In step S103, the CPU 40 controls the motor 41 to move the supporting members 30 to the first position.

Next, in step S104, the CPU 40 determines whether a jam occurs during the execution of print job. If a jam occurs (YES in step S104), the operation proceeds to step S106. In step S106, the CPU 40 controls the motor 41 to move the supporting members 30 to the second position. If the job is completed without a jam (YES in step S105), the operation proceeds to step S107. In step S107, the CPU 40 controls the motor 41 to move the supporting members 30 to the second position and ends the operation.

In step S101, the CPU 40 may determine whether to execute strong curl correction based on information about sheets specified by the user or based on the amount of toner loaded, besides the information input via the operation unit 200. For example, the CPU 40 may determine that strong curl correction needs to be executed in a case where thick paper having large sheet grammage is used.

As described above, with the curl correction apparatus 3*a* according to the first exemplary embodiment, in a case where the supporting members 30 are located at the first or third position, both shafts of the elastic roller 22 and the metal roller 23 are supported so that the metal roller 23 penetrates into the elastic roller 22. Because of its high strength, even if the supporting members 30 receive repulsive force from the elastic roller 22 into which the metal roller 23 penetrates, the supporting members 30 is not significantly deformed. Thus, the axis distance between the two rollers can be stably maintained, so that stable curl correction can be executed. In addition, in a case where the supporting members 30 are located at the second position, the supporting members 30 do not engage with the metal roller 23 but supports only the shaft of the elastic roller 22. Thus, when a jam handling process is executed, the user can open the lower conveyance guide 21 substantially integrally with the metal roller 23. Thus, when a jam handling process is executed, since the user can easily view the sheet along the conveyance path and can easily reach the jammed sheet, the user can easily remove the sheet.

In addition, the position of the elastic roller 22 is fixed to the upper conveyance guide 20 and the slit grooves 37 for holding the metal roller 23 in the upper conveyance guide 20 are arranged, so that the position of the metal roller 23 with respect to the elastic roller 22 can be accurately maintained.

In addition, according to the first exemplary embodiment, the upper conveyance guide 20 and the lower conveyance guide 21 are provided with the elastic roller 22 and the metal roller 23, respectively, pressing force of the curl correction roller pair is generated between the two independent conveyance guides, and the supporting members 30 are arranged for the upper conveyance guide 20 to which the elastic roller 22 is fixed. In addition, the supporting members 30 are formed to have a certain level of rigidity, so that movement of the metal roller 23 by the repulsive force from the elastic roller 22 is regulated. In this way, there is no need to increase the strength of parts of the upper conveyance guide 20 and the lower conveyance guide 21 or to increase the positional accuracy of the latching means 50 latching the upper conveyance guide 20 and the lower conveyance guide 21. Thus, even if the pressing force of the curl correction roller pair is increased, stable holding can be achieved. Namely, the number of parts and the cost of the curl correction apparatus 3*a* can be reduced.

In addition, according to the first exemplary embodiment, the supporting members 30 move in the direction perpendicular to the direction in which the elastic roller 22 and the metal roller 23 are pressed against each other. Namely, since the supporting members 30 move in the conveyance direction, the relay conveyance apparatus 3 can be formed to have a low height.

In addition, the supporting members 30 include the abutting surfaces 30*a* and 30*b* for pinching the shaft of the metal roller 23, and the abutting surfaces 30*a* and 30*b* are formed to have a certain width. In this way, a certain distance between the rotation shafts of the two rollers 22 and 23 can stably be maintained, without requiring high accuracy for parts for moving the supporting members 30 such as for the rotation amount of the cams 35.

A second exemplary embodiment will be described.

Figure 12A:
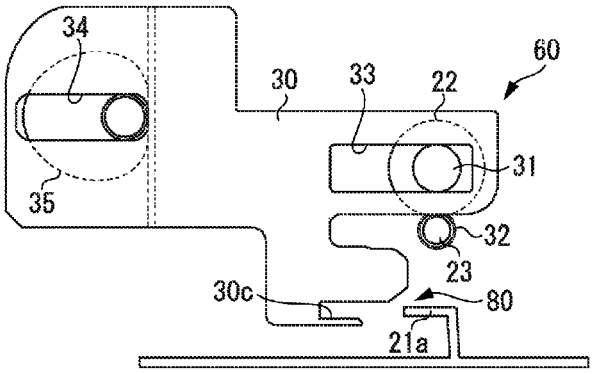
FIGS. 12A and 12B illustrate a curl correction apparatus according to a second exemplary embodiment.
Figure 12B:
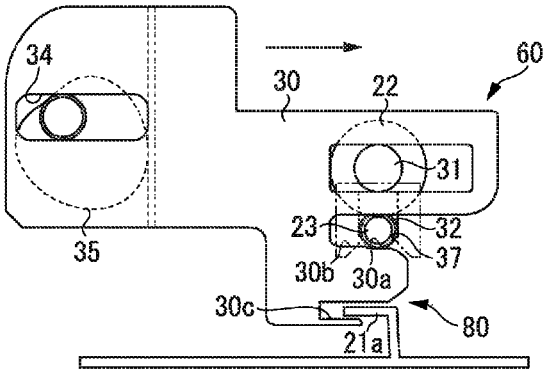

Next, a second exemplary embodiment of the present disclosure will be described. FIGS. 12A and 12B are side views of a curl correction apparatus 60 according to the second exemplary embodiment. With the curl correction apparatus 60 according to the second exemplary embodiment, the supporting members 30 are provided with a locking mechanism 80 for the lower conveyance guide 21 and the metal roller 23. Since other components and operations are the same as those according to the first exemplary embodiment, redundant description thereof will be avoided.

The locking mechanism 80 includes a locking groove 30*c* arranged for the supporting members 30 and a locking projection 21*a* arranged for the lower conveyance guide 21. The supporting members 30 move from the second position illustrated in FIG. 12A to the first position illustrated in FIG. 12B, so that the locking projection 21*a* engages with the locking groove 30*c*. In this way, the supporting members 30 are locked so that the lower conveyance guide 21 cannot be opened.

In this state, the distance between the upper conveyance guide 20 and the lower conveyance guide 21 may be fixed by the latching projection 25 arranged for the lower conveyance guide 21 or by engagement between the supporting members 30 and part of the lower conveyance guide 21.

Thus, according to the second exemplary embodiment, since the locking mechanism 80 locks the lower conveyance guide 21 and the supporting members 30, it is possible to prevent a user from erroneously opening the lower conveyance guide 21 during a printing operation.

A third exemplary embodiment will be described.

Figure 13A:
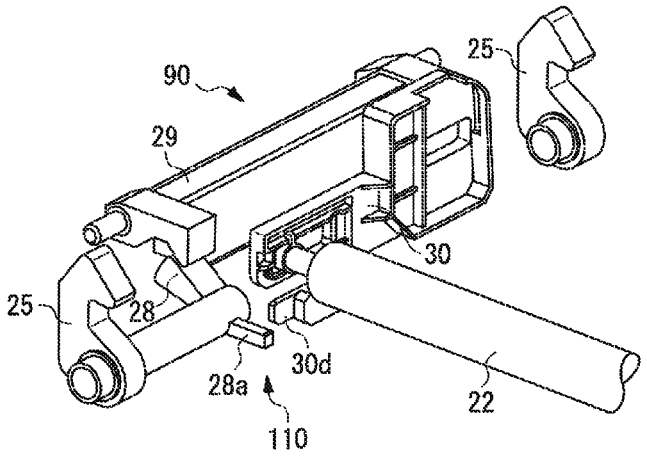
FIGS. 13A and 13B illustrate a curl correction apparatus according to a third exemplary embodiment.
Figure 13B:
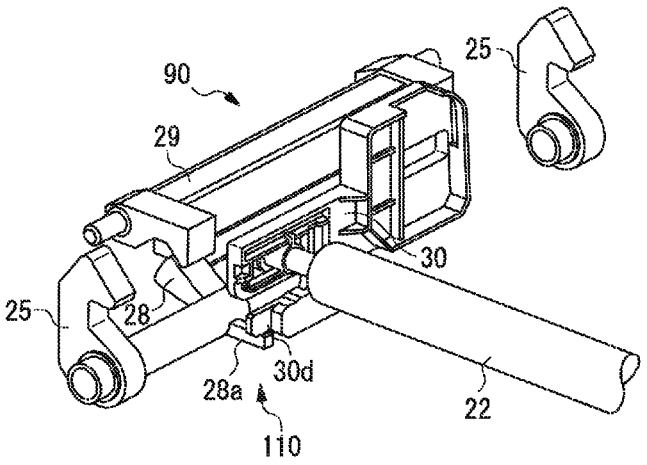
Figure 14:
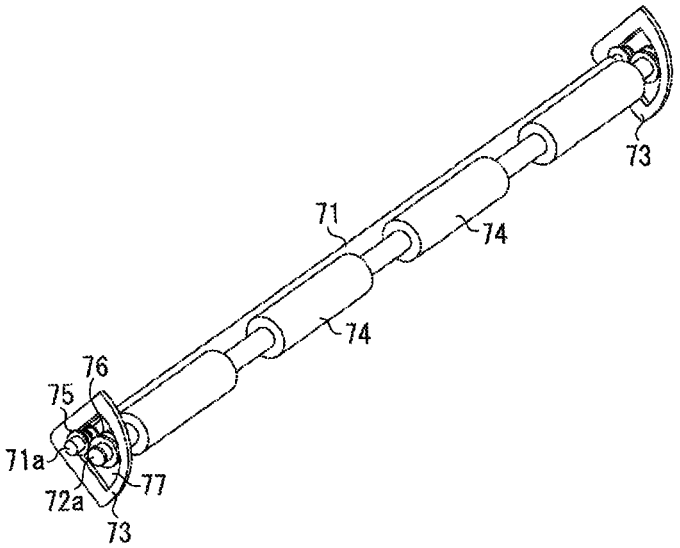
FIG. 14 is a perspective view illustrating a conventional curl correction apparatus.
Figure 15:
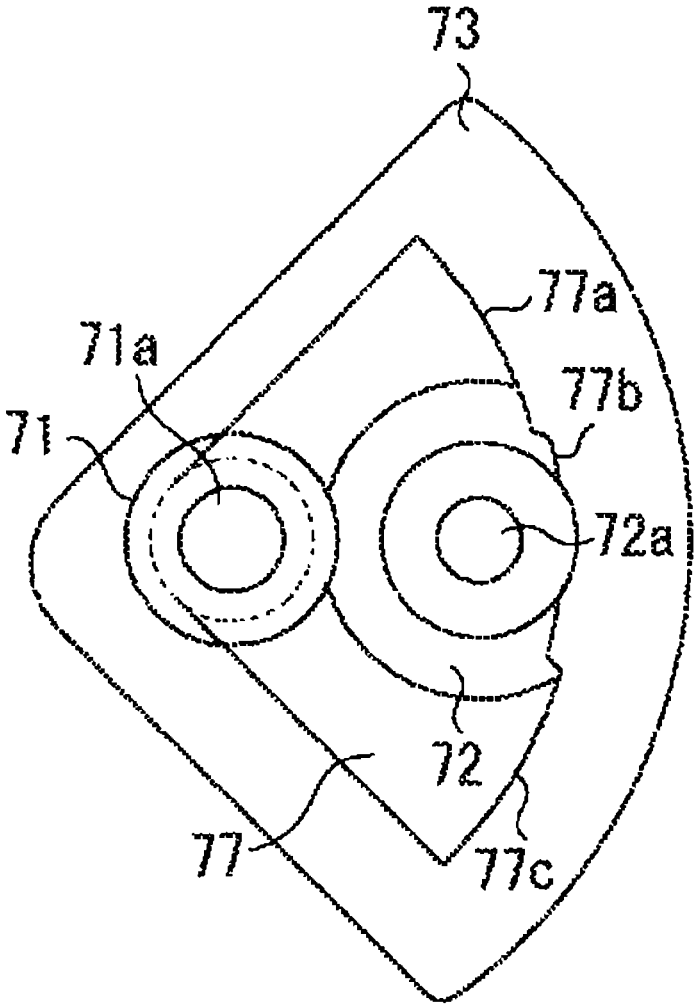
FIG. 15 is a side view illustrating the conventional curl correction apparatus.

Next, a third exemplary embodiment disclosed herein will be described. FIGS. 13A and 13B are perspective views of a curl correction apparatus 90 according to the third exemplary embodiment.

The curl correction apparatus 90 according to the third exemplary embodiment is different from the curl correction apparatus 3*a* according to the first exemplary embodiment only in that the curl correction apparatus 90 includes a regulating mechanism 110 for regulating movement of the handle 29 which latches and releases the latching means 50 that latches the upper conveyance guide 20 and the lower conveyance guide 21. Thus, since other components and operations are the same as those according to the first exemplary embodiment, redundant description thereof will be avoided.

The regulating mechanism 110 includes a stopper 30*d* arranged for the supporting members 30 and a regulating lever 28*a* arranged for the latching means 50.

As illustrated in FIG. 13B, in a case where the supporting members 30 are located at the first or third position, since movement of the regulating lever 28*a* is regulated by the stopper 30*d*, even when the user moves the handle 29, the user cannot open the lower conveyance guide 21.

As illustrated in FIG. 13A, in a case where the supporting members 30 are located at the second position, since the stopper 30*d* does not regulate movement of the regulating lever 28*a*, the user can move the handle 29 to open the lower conveyance guide 21.

Thus, according to the third exemplary embodiment, in a case where the supporting members 30 are located at the first or third position, since the regulating mechanism 110 regulates movement of the handle 29, it is possible to prevent a user from erroneously opening the lower conveyance guide 21 during a printing operation.

In the description of the above first to third exemplary embodiments, the supporting members 30 support only the elastic roller 22 at the second position. However, the present invention is not limited thereto. The supporting members 30 may support only the metal roller at the second position.

In addition, in the description of the above first to third exemplary embodiments, plate-shaped metal members are used as the supporting members 30. However, high strength metal pieces for preventing deformation may be attached to plate-shaped plastic members, and the obtained combined members may be used as the supporting members 30.

In addition, in the above description, the metal roller 23 and the lower conveyance guide 21 are integrally opened. However, the present invention is not limited thereto. The present disclosure is applicable as long as one of the elastic roller and the metal roller is integrally opened with one of the upper conveyance guide and the lower conveyance guide.

In addition, in the above description, the CPU 40 moves the supporting members 30, for example, based on information about conveyed sheets or whether a sheet is jammed. However, the present invention is not limited thereto. For example, a user may manually move the supporting members 30.

According to the present disclosure, the supporting members support the shafts of the elastic roller and the counter roller at the first position, so that the axis distance between the curl correction roller pair can stably be maintained. In addition, the supporting member moving unit moves the supporting members between the first position and the second position, and at the second position, the supporting members support only the shaft of one of the elastic roller and the counter roller. In addition, when the supporting members are located at the second position, by moving the other of the elastic roller and the counter roller, the nip of the curl correction roller pair can be opened. Thus, when a jam handling process is executed, a user can easily remove a sheet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-137920 filed Jun. 19, 2012, which is hereby incorporated by reference herein in its entirety.

What is claimed is:

1. A curl correction apparatus comprising:

an elastic roller;

a counter roller configured to face the elastic roller, wherein a sheet passes through a nip portion between the elastic roller and the counter roller;

a supporting member having a first portion engaging with one of a shaft of the elastic roller and a shaft of the counter roller and a second portion engaging with other of the shaft of the elastic roller and the shaft of the counter roller, the supporting member supporting the elastic roller and the counter roller so the counter roller penetrates the elastic roller to form the nip portion at a first position; and a moving portion configured to move the supporting member from the first position to a second position where the second portion disengages with the other of the shaft of the elastic roller and the shaft of the counter roller, wherein, in a case where the supporting member is located at the second position by the moving portion, the nip portion between the elastic roller and the counter roller can be opened.

2. The curl correction apparatus according to claim 1, wherein the moving unit moves the supporting member in a direction perpendicular to a direction in which the elastic roller and the counter roller are pressed against each other.

3. The curl correction apparatus according to claim 1, wherein the moving unit comprises:

a cam configured to rotate in order to move the supporting member; and a drive unit configured to rotate the cam.

4. The curl correction apparatus according to claim 1, wherein the supporting member supports the shaft of the elastic roller and the shaft of the counter roller at a third position so an axis distance between the elastic roller and the counter roller is shorter than an axis distance between the elastic roller and the counter roller at the first position, and wherein the moving unit moves the supporting member between the third position and the second position.

5. The curl correction apparatus according to claim 4, wherein the moving unit moves the supporting member to the first position or the third position based on information about a conveyed sheet.

6. The curl correction apparatus according to claim 1, further comprising;

an upper conveyance guide configured to guide a conveyed sheet; and a lower conveyance guide configured to guide a conveyed sheet, wherein, the nip portion between the elastic roller and the counter roller is opened by moving the other of the elastic roller and the counter roller integrally with one of the upper conveyance guide and the lower conveyance guide.

7. The curl correction apparatus according to claim 6, wherein the other of the upper conveyance guide and the lower conveyance guide is provided with a groove, and wherein the other of the elastic roller and the counter roller is fitted into the groove and is supported by the supporting member.

8. The curl correction apparatus according to claim 6, further comprising:

a latching unit configured to latch the upper conveyance guide and the lower conveyance guide while maintaining a predetermined distance therebetween;

a handle configured to be arranged for one of the upper conveyance guide and the lower conveyance guide and to open one of the upper conveyance guide and the lower conveyance guide by releasing the latching of the locking unit; and a regulating unit configured, in a case where the supporting member is located at the first position, to regulate movement of the handle.

9. An image forming apparatus, comprising:

an image forming unit configured to form an image on a sheet; and the curl correction apparatus according to claim 1 configured to correct a curl of the sheet having an image formed by the image forming unit.

10. The curl correction apparatus according to claim 1, wherein the moving unit linearly moves the supporting member.

11. The curl correction apparatus according to claim 1, wherein the moving portion moves the supporting member from the first position to the second position in a moving direction so that an upstream end of the second portion in the moving direction passes the other of the shaft of the elastic roller and the shaft of the counter roller.

12. A curl correction apparatus comprising:

an elastic roller;

a counter roller configured to face the elastic roller, wherein a sheet passes through a nip portion between the elastic roller and the counter roller;

a supporting member engaging with one of a shaft of the elastic roller and a shaft of the counter roller and having an engaging portion engaging with other of the shaft of the elastic roller and the shaft of the counter roller, the supporting member supporting the elastic roller and the counter roller so the counter roller penetrates the elastic roller to form the nip portion at a first position; and a moving portion configured to move the supporting member from the first position in a moving direction so that an upstream end of the engaging portion in the moving direction passes the other of the shaft of the elastic roller and the shaft of the counter roller.

13. The curl correction apparatus according to claim 12, wherein the moving unit moves the supporting member in the moving direction perpendicular to a direction in which the elastic roller and the counter roller are pressed against each other.

14. The curl correction apparatus according to claim 12, wherein the moving unit comprises:

a cam configured to rotate in order to move the supporting member; and a drive unit configured to rotate the cam.

15. The curl correction apparatus according to claim 12, wherein the supporting member supports the shaft of the elastic roller and the shaft of the counter roller at a third position so an axis distance between the elastic roller and the counter roller is shorter than an axis distance between the elastic roller and the counter roller at the first position, and wherein the moving unit moves the supporting member between the third position and the first position.

16. The curl correction apparatus according to claim 15, wherein the moving unit moves the supporting member to the first position or the third position based on information about a conveyed sheet.

17. The curl correction apparatus according to claim 12, further comprising;

an upper conveyance guide configured to guide a conveyed sheet; and an lower conveyance guide configured to guide a conveyed sheet, wherein, the nip portion between the elastic roller and the counter roller is opened by moving the other of the elastic roller and the counter roller integrally with one of the upper conveyance guide and the lower conveyance guide.

18. The curl correction apparatus according to claim 17, wherein the other of the upper conveyance guide and the lower conveyance guide is provided with a groove, and wherein the other of the elastic roller and the counter roller is fitted into the groove and is supported by the supporting member.

19. The curl correction apparatus according to claim 17, further comprising:

a latching unit configured to latch the upper conveyance guide and the lower conveyance guide while maintaining a predetermined distance therebetween;

a handle configured to be arranged for one of the upper conveyance guide and the lower conveyance guide and to open one of the upper conveyance guide and the lower conveyance guide by releasing the latching of the locking unit; and a regulating unit configured, in a case where the supporting member is located at the first position, to regulate movement of the handle.

20. The curl correction apparatus according to claim 12, wherein the moving unit linearly moves the supporting member.

* * * * *